US010406548B2

(12) United States Patent
Fujiwara et al.

(10) Patent No.: US 10,406,548 B2
(45) Date of Patent: Sep. 10, 2019

(54) TRIGGER-TYPE LIQUID DISPENSER

(71) Applicants: Kotaro Fujiwara, Tokyo (JP); Shigeo Iizuka, Tokyo (JP)

(72) Inventors: Kotaro Fujiwara, Tokyo (JP); Shigeo Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 15/317,756

(22) PCT Filed: Jun. 29, 2015

(86) PCT No.: PCT/JP2015/003254
§ 371 (c)(1),
(2) Date: Dec. 9, 2016

(87) PCT Pub. No.: WO2016/002190
PCT Pub. Date: Jan. 7, 2016

(65) Prior Publication Data

US 2017/0120277 A1 May 4, 2017

(30) Foreign Application Priority Data

Jun. 30, 2014 (JP) ..... 2014-135219
Dec. 26, 2014 (JP) ..... 2014-265337

(51) Int. Cl.
*B05B 11/00* (2006.01)
*F04B 9/14* (2006.01)

(52) U.S. Cl.
CPC ..... *B05B 11/3067* (2013.01); *B05B 11/00* (2013.01); *B05B 11/0059* (2013.01);
(Continued)

(58) Field of Classification Search
CPC ..... B05B 11/0059; B05B 11/3011; B05B 11/3045; B05B 11/3067; B05B 11/3077; B05B 11/00; F04B 9/14
See application file for complete search history.

(56) References Cited

U.S. PATENT DOCUMENTS 4,775,079 A * 10/1988 Grothoff ..... B05B 11/0059 222/321.4
4,942,985 A * 7/1990 Schultz ..... B05B 11/0059 222/376

(Continued)

FOREIGN PATENT DOCUMENTS

EP 0 380 743 A2 8/1990
JP H02-207862 A 8/1990

(Continued)

OTHER PUBLICATIONS

Jul. 21, 2015 International Search Report issued in International Patent Application No. PCT/JP2015/003254.

(Continued)

*Primary Examiner* — David P Angwin
*Assistant Examiner* — Bob Zadeh
(74) *Attorney, Agent, or Firm* — Oliff PLC

(57) ABSTRACT

A trigger-type liquid dispenser, in which an upright and inverted dual unit includes a joint member, a pipe holding member, and a valve body. The joint member includes a through hole, which may be closed by the valve body, a valve-body-holding wall portion, which accommodates the valve body above the through hole in a manner such that the valve body is displaceable upward and downward, and an opening portion, which is formed in the valve-body-holding wall portion. In the inverted position, the upright and inverted dual unit permits content liquid contained in a container to be supplied to the dispenser main body by passing content liquid through a flow path from opening (Continued)

portion, through the hole, to the flow path defined between the joint member and pipe holding member sequentially. The valve body is inserted through the opening portion to be accommodated in the valve-body-holding wall portion.

7 Claims, 7 Drawing Sheets

(52) U.S. Cl.
CPC ..... *B05B 11/3011* (2013.01); *B05B 11/3045* (2013.01); *B05B 11/3077* (2013.01); *F04B 9/14* (2013.01)

(56) References Cited

U.S. PATENT DOCUMENTS 5,341,967 A * 8/1994 Silvenis ..... B05B 11/0059 222/376
5,462,209 A * 10/1995 Foster ..... B05B 11/0059 222/376
5,467,901 A * 11/1995 Foster ..... B05B 11/0059 222/376
5,540,360 A * 7/1996 Foster ..... B05B 11/0059 222/376
6,293,441 B1 * 9/2001 Tasaki ..... B05B 11/0059 222/376
6,386,399 B1 * 5/2002 Tsujii ..... B05B 11/0059 222/376
2017/0065994 A1 * 3/2017 Fujiwara ..... B05B 11/3011
2017/0113238 A1 * 4/2017 Fujiwara ..... B05B 11/3011
2017/0120277 A1 * 5/2017 Fujiwara ..... B05B 11/3067

FOREIGN PATENT DOCUMENTS

JP H08-332423 A 12/1996
JP H11-263364 A 9/1999
JP H11-290732 A 10/1999
JP 2005-034714 A 2/2005
JP 2007-175609 A 7/2007

OTHER PUBLICATIONS

Jan. 3, 2017 International Preliminary Report on Patentability issued in International Patent Application No. PCT/JP2015/003254.
Jan. 25, 2018 extended European Search Report issued in European Application No. 15815980.6.
Jul. 24, 2018 Office Action issued in Chinese Application No. 201580031247.2.
Jul. 10, 2018 Office Action issued in Japanese Application No. 2014-265337.
Mar. 22, 2019 Office Action issued in Chinese Application No. 201580031247.2.

* cited by examiner

TRIGGER-TYPE LIQUID DISPENSER

TECHNICAL FIELD

The present disclosure relates to a trigger-type liquid dispenser including a dispenser main body that is attached to a mouth of a container and that includes a pump, and an upright and inverted dual unit that allows supply of a content liquid to the dispenser main body regardless of whether the container is in an upright position or an inverted position. In detail, the present disclosure is to reduce the number of components in the upright and inverted dual unit and to facilitate assembly of the upright and inverted dual unit.

BACKGROUND

Trigger-type liquid dispensers are widely used in containers containing a content liquid, such as an antimold, a detergent, a sizing agent for textiles, a household wax, a hair liquid, an aromatic, a repellent, a pesticide, and a medicine. Such a trigger-type liquid dispenser is mounted to a mouth of the container and injects the liquid contained in the container in the form of a straight jet, mist, or foam by actuation of a pump, disposed in a dispenser main body, in response to pulling of an operating lever, thereby allowing efficient supply of the content liquid. A known example of such a dispenser also includes an upright and inverted dual unit that allows supply of the content liquid to the dispenser main body regardless of whether the container is in the upright position or the inverted position.

For example, in the dispenser described in Patent Literature 1, the upright and inverted dual unit is configured by a joint member attached to the dispenser main body, a pipe holding member that is attached to the joint member and that holds a drawing pipe (which is configured by a tube member and an attachment member in Patent Literature 1) suspended in the container, an intermediate member interposed between the joint member and the pipe holding member to be held, and a valve body that may close from above a through hole provided in the intermediate member. Between the joint member and the intermediate member, there is defined a valve body receiving chamber in which the valve body is received above the through hole in a manner such that the valve body is displaceable upward and downward. Furthermore, the joint member is provided with an orifice through which the content liquid contained in the container is introduced into the valve receiving chamber.

In the inverted position of the container, the upright and inverted dual unit permits the content liquid contained in the container to be supplied to the dispenser main body by passing the content liquid through a flow path from the orifice, the valve body receiving chamber, the through hole, to a flow path defined between the intermediate member and the pipe holding member sequentially. On the other hand, in the upright position of the container, the upright and inverted dual unit permits the content liquid to be supplied from the drawing pipe to the dispenser main body by the valve body closing the through hole.

CITATION LIST

Patent Literature

PTL 1: JP2005034714A

SUMMARY

Technical Problem

However, since the trigger-type liquid dispenser as described in Patent Literature 1 is configured by the four members, namely, the joint member, the pipe holding member, the intermediate member, and the valve body, and there is a demand for a further reduction in the number of components. Furthermore, in assembly of the upright and inverted dual unit from when the valve body is inserted between the joint member and the intermediate member to when the pipe holding member is attached to the joint member, the intermediate member might be disengaged from the joint member, and the valve body might fall. Accordingly, there is also a demand for facilitating the assembly.

The present disclosure has been conceived in view of the above current situation, and the present disclosure is to provide a trigger-type liquid dispenser that reduces the number of components in the upright and inverted dual unit and that facilitates assembly of the upright and inverted dual unit.

Solution to Problem

Summary and features of the present disclosure are as follows.

1. A trigger-type liquid dispenser including a dispenser main body that is attached to a mouth of a container and that includes a pump, an upright and inverted dual unit that permits supply of a content liquid contained in the container to the dispenser main body regardless of whether the container is in an upright position or an inverted position, and an operation lever that is supported swingably by the dispenser main body and that is configured to actuate the pump, wherein the dispenser main body draws, pressurizes, and force-feeds the content liquid supplied from the upright and inverted dual unit and dispenses the content liquid through a nozzle attached to the dispenser main body due to actuation of the pump in response to pulling of the operation lever. The upright and inverted dual unit includes a joint member that is attached to the dispenser main body, a pipe holding member that is attached to the joint member and that holds a drawing pipe suspended in the container, and a valve body. The joint member includes a through hole that is closable from above by the valve body, a valve-body-holding wall portion that accommodates the valve body above the through hole in a manner such that the valve body is displaceable upward and downward and is prevented from slipping off, and an opening portion that is formed in the valve-body-holding wall portion. In the inverted position, the upright and inverted dual unit permits the content liquid contained in the container to be supplied to the dispenser main body by passing the content liquid through a flow path from the opening portion, the through hole, to a flow path defined between the joint member and the pipe holding member sequentially, and in the upright position, the upright and inverted dual unit permits the content liquid to be supplied from the drawing pipe to the dispenser main body by the valve body closing the through hole. The valve body is inserted through the opening portion to be accommodated in the valve-body-holding wall portion.

2. The trigger-type liquid dispenser according to 1, wherein the valve-body-holding wall portion includes a pair of curved plate portions facing to each other with a distance provided therebetween.
3. The trigger-type liquid dispenser according to 2, wherein the joint member further includes an inserted tubular portion that is inserted to the dispenser main body and that defines inside thereof a flow path for the content liquid, and the valve-body-holding wall portion is configured by a portion of an outer circumferential surface of the inserted tubular portion and the pair of curved plate portions.
4. The trigger-type liquid dispenser according to 2 or 3, wherein the valve-body-holding wall portion further includes a concave portion that, in a sideways position, permits the valve body to be positioned on an abutment surface of the valve-body-holding wall portion with respect to the valve body, with a predetermined gap provided with respect to the through hole.
5. The trigger-type liquid dispenser according to any one of 2 to 4, wherein each of the pair of curved plate portions includes a narrowed portion on un upper end edge of the curved plate portion, the narrowed portion being curved inward.
6. The trigger-type liquid dispenser according to 5, wherein the narrowed portion has a dome shape.
7. The trigger-type liquid dispenser according to any one of 1 to 6, wherein the joint member further includes, in a position thereof opposed to the pump about a center axis of a pipe holding tubular portion included in the pipe holding member, a plurality of ribs that is disposed in a circumferential direction at a predetermined interval and that extends in a direction of the center axis.

Advantageous Effects

According to the present disclosure, the joint member includes the through hole that is closable from above by the valve body, the valve-body-holding wall portion that accommodates the valve body above the through hole in a manner such that the valve body is displaceable upward and downward and is prevented from slipping off, and the opening portion that is formed in the valve-body-holding wall portion. Furthermore, in the inverted position of the container, the upright and inverted dual unit permits the content liquid contained in the container to be supplied to the dispenser main body by passing the content liquid through a flow path from the opening portion, the through hole, to a flow path defined between the joint member and the pipe holding member sequentially, and in the upright position of the container, the upright and inverted dual unit permits the content liquid to be supplied from the drawing pipe to the dispenser main body by the valve body closing the through hole. Moreover, the valve body is inserted through the opening portion to be accommodated in the valve-body-holding wall portion. Accordingly, the upright and inverted dual unit may be configured by the three members, namely, the joint member, the pipe holding member, and the valve body. Thus, the intermediate member, which is conventionally needed, may be omitted, and the number of components is reduced. Besides, regarding assembly of the upright and inverted dual unit according to the present disclosure, the valve body is inserted through the opening portion to be accommodated in the valve-body-holding wall portion in a manner such that the valve body is prevented from slipping off. Accordingly, subsequent falling of the valve body is prevented, and the assembly is facilitated.

The present disclosure thus provides a trigger-type liquid dispenser that reduces the number of components in the upright and inverted dual unit and that facilitates the assembly of the upright and inverted dual unit.

DETAILED DESCRIPTION

Figure 1:
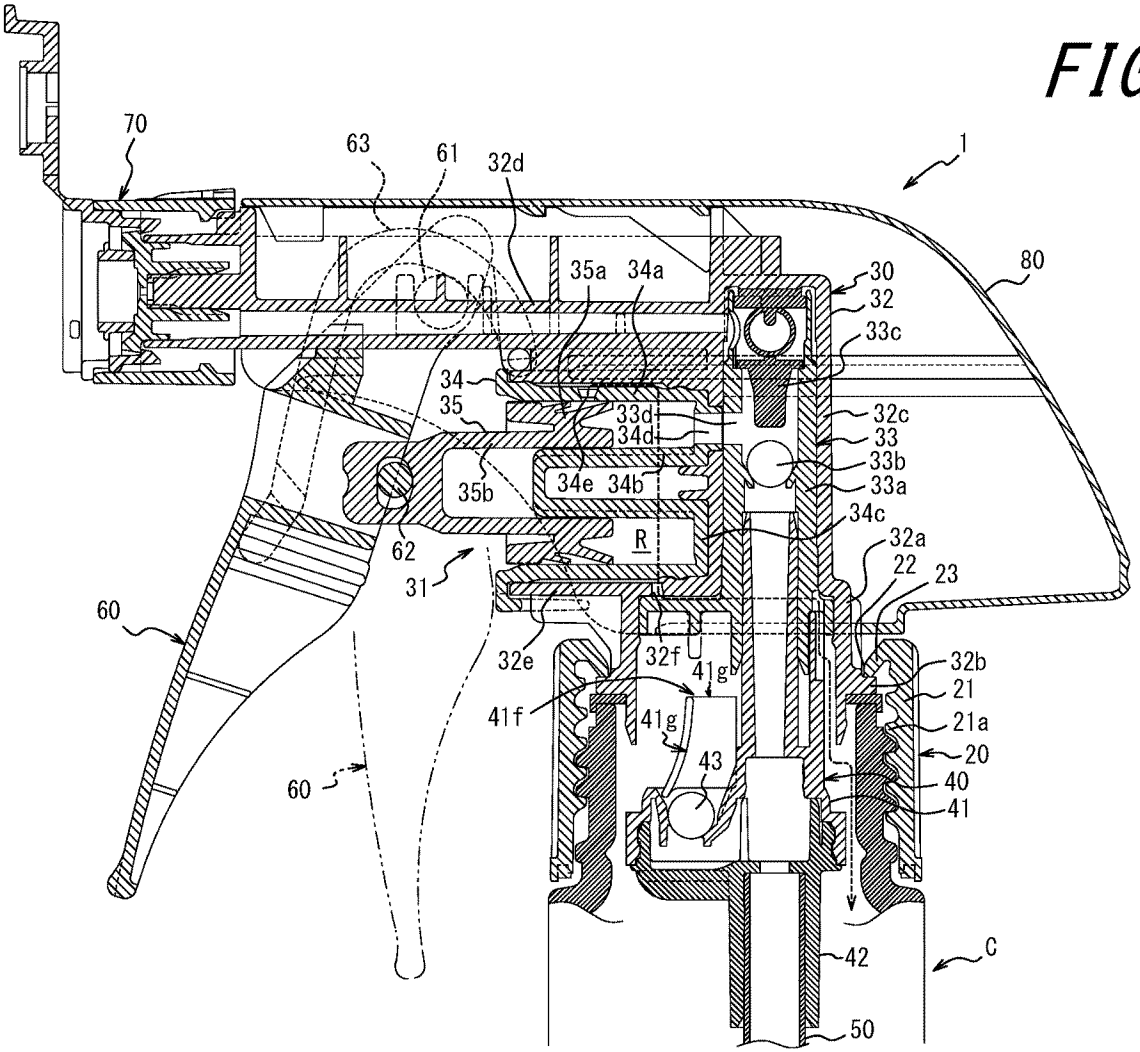
FIG. 1 is a side sectional view illustrating the state where a trigger-type liquid dispenser is attached to a mouth of a container according to the first embodiment of the present disclosure.

The present disclosure will be described in more detail below by illustration with reference to the drawings. Note that, in the specification, the claims, the abstract, and the drawings of the present disclosure, the side (corresponding to the upper side in FIG. 1) on which a top wall of a cover 80, which is later described, is located is defined as upper direction, and the side (corresponding to the lower side in FIG. 1) on which a fitting cap 20 is disposed is defined as lower direction. Furthermore, the side (corresponding to the left side in FIG. 1) on which a nozzle 70 is disposed is defined as front direction, and the opposing side (corresponding to the right side in FIG. 1) is defined as rear direction. Moreover, the directions (corresponding to the directions that are orthogonal to the drawing in FIG. 1) that are orthogonal to the upper-lower direction and the front-rear direction are defined as side directions.

As illustrated in FIG. 1, a trigger-type liquid dispenser 1 according to the first embodiment of the present disclosure includes the fitting cap 20, which is attached to a mouth of a container C, a dispenser main body 30, which holds the fitting cap 20 in a manner such that the fitting cap 20 is rotatable and is prevented from slipping off, an upright and inverted dual unit 40, which permits supply of a content liquid contained in the container C to the dispenser main body 30 regardless of whether the container C is in an upright position or an inverted position, a drawing pipe 50, which is suspended in the container C, an operation lever (trigger) 60, which is supported swingably by the dispenser main body 30 and configured to actuate a pump 31 included in the dispenser main body 30, the nozzle 70, which is attached to a front portion of the dispenser main body 30 to dispense the content liquid to the outside, and the cover 80, which covers the upper side and the sides of the dispenser main body 30.

The fitting cap 20 includes, on an inner surface of a cylindrical-shaped side wall 21 thereof, a screw portion 21*a* configured to engage with a screw portion provided in the mouth of the container C. Above the side wall 21, a ceiling wall 23, which is provided in the middle thereof with an upper orifice 22, is disposed.

In the present embodiment, the dispenser main body 30 is configured by a plurality of members, and the fitting cap 20 is attached to a body 32, which is one of the plurality of members. The body 32 includes a cylindrical-shaped coupling tubular portion 32*a*, which is inserted through the upper orifice 22 provided in the fitting cap 20, and also includes a flange 32*b*, which is disposed on an outer circumferential surface of the coupling tubular portion 32*a* to extend to the outer side in the radial direction. Below the flange 32*b*, a packing is also disposed to be sandwiched between an upper end of the mouth of the container C and the flange 32*b*. Furthermore, the body 32 includes, above the coupling tubular portion 32*a*, a longitudinal tube 32*c*, whose diameter is smaller than that of the coupling tubular portion 32*a*, and also includes, above the longitudinal tube 32*c*, a horizontal tube 32*d*, which extends toward the front side and which is connected to the longitudinal tube 32*c*. The nozzle 70 is disposed in a front end portion of the horizontal tube 32*d*. Below the horizontal tube 32*d*, a cylindrical-shaped fitting wall 32*e*, which protrudes toward the front side from the longitudinal tube 32*c*, is disposed.

There is also disposed a tubular portion 33*a* of an intake 33 inside the longitudinal tube 33*c*. Furthermore, the tubular portion 33*a* of the intake 33 is provided, inside thereof, with the first check valve 33*b* and the second check valve 33*c* that prevent backflow of the content liquid drawn by the pump 31. The first check valve 33*b* is brought into an opened state when the content liquid is drawn by the pump 31 and brought into a closed state when the drawn content liquid is pressurized and force-fed. On the other hand, the second check valve 33*c* is brought into a closed state when the content liquid is drawn by the pump 31 and brought into a closed state when the drawn content liquid is pressurized and force-fed toward the nozzle 70.

There is also provided a cylinder member 34 on the inner side of the fitting wall 32*e* of the body 32. The cylinder member 34 has a coaxial double-tube structure consisting of a cylindrical-shaped cylinder tube 34*a*, which is fitted to and held by the fitting wall 32*e*, and a cylindrical-shaped partition tube 34*b*, which is disposed on the inner side of the cylinder tube 34*a* in the radial direction. The cylinder tube 34*a* and the partition tube 34*b* are connected to each other on the rear sides thereof via a back wall 34*c*.

The back wall 34*c* is provided with a hole 34*d* that is fitted in a hole of the longitudinal tube 32*c* and that communicates with a hole 33*d* of the intake 33. Furthermore, the cylinder tube 34*a* is provided, on the side thereof, with an ambient air inlet 34*e* that permits the inside of the cylinder tube 34*a* to communicate with the outside and that communicates with a hole 32*f* provided in the fitting wall 32*e* via a gap formed between the fitting wall 32*e* and the cylinder tube 34*a*.

Inside the cylinder member 34, a piston 35 is disposed. The piston 35 seals the inside of the cylinder member 34 and defines a cylinder chamber R. The piston 35 includes an annular-shaped slide portion 35*a*, which slidably abuts against an inner circumferential surface of the cylinder tube 34*a*, and the slide portion 35*a* is provided with a circumferential wall portion 35*b*, which extends toward the front side and which has a closed front end. Additionally, the slide portion 35*a* closes the aforementioned ambient air inlet 34*e* provided in the cylinder member 34 in the state where the operating lever 60 is not pulled.

To the dispenser main body 30, the operation lever 60, which is rotatable about a pivot shaft 61, is fitted. The operation lever 60 is coupled to a front end of the piston 35 by a pin member 62 in a manner such that the operation lever 60 is rotatable. Furthermore, the operation lever 60 is urged toward a direction (a clockwise direction centered about the pivot shaft 61 in FIG. 1) away from the pump 31 by a curve-shaped plate spring 63, which has one end fixed to and held by the dispenser main body 30 and also has a front end locked to the operation lever 60.

Although in the present embodiment the pump 31 is configured by the cylinder member 34 and the piston 35, the present disclosure is not limited to this configuration, and it is possible to adopt a variety of configurations and structures, which permits the content liquid supplied from the upright and inverted dual unit 40 to be drawn, pressurized, and force-fed to be dispensed through the nozzle 70 due to actuation of the pump 31 in response to pulling of the operation lever 60.

Figure 2:
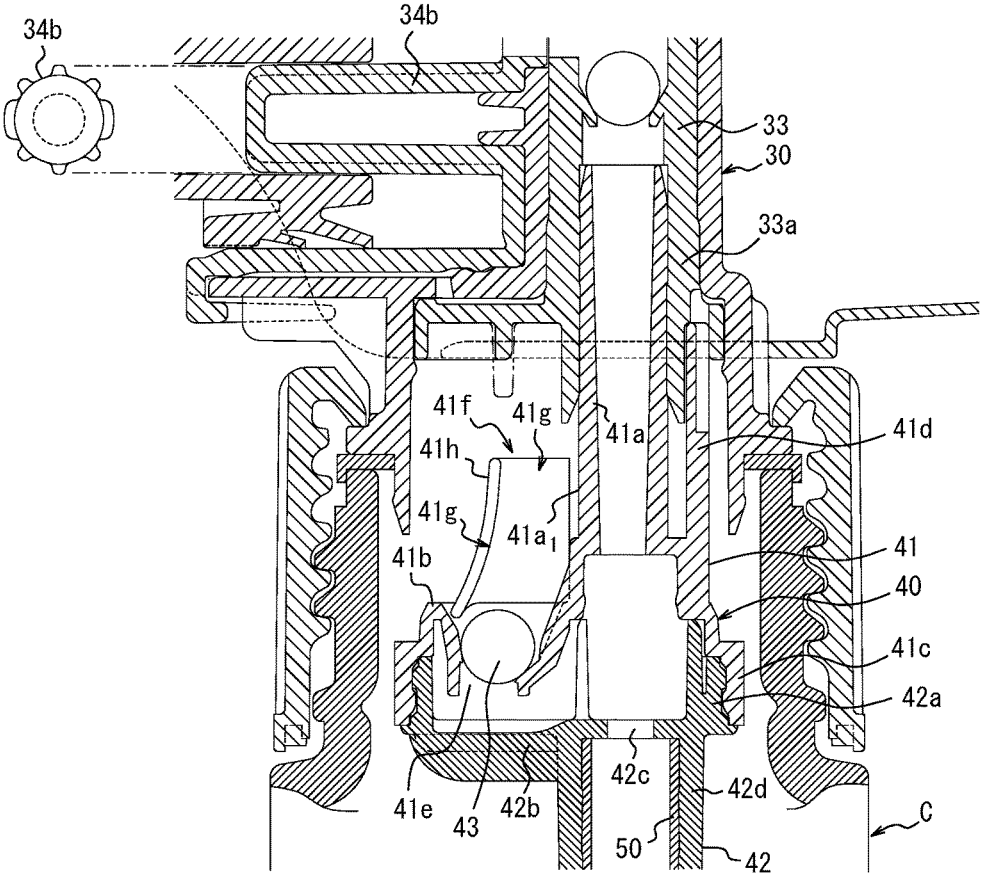
FIG. 2 is a partially enlarged view of FIG. 1, supplemented with a front view of a partition tube of a cylinder member.
Figure 3C:
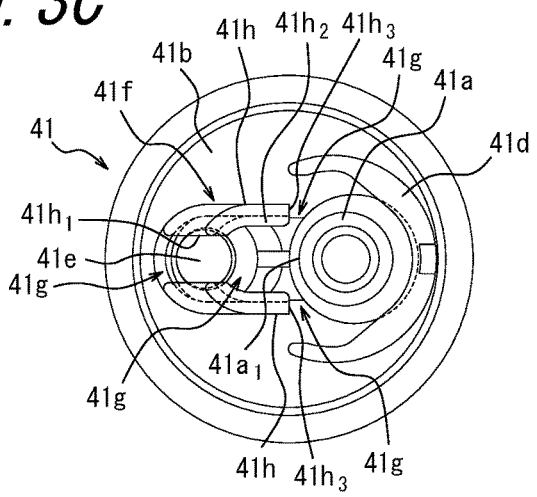
FIG. 3C is a plan view, each illustrating a joint member constituting an upright and inverted dual unit of a trigger-type liquid dispenser illustrated in FIG. 1.
Figure 3B:
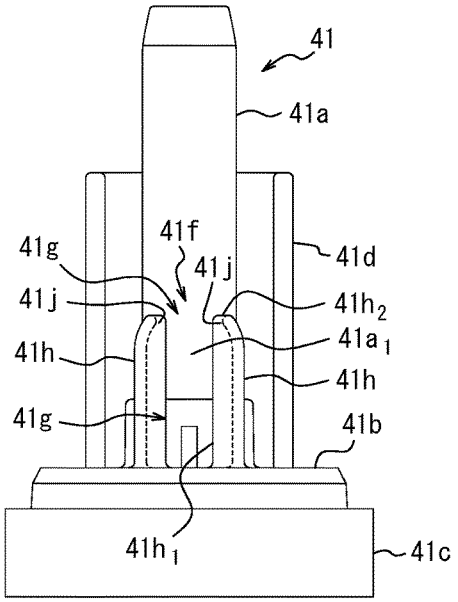
FIG. 3B is a front view.
Figure 3A:
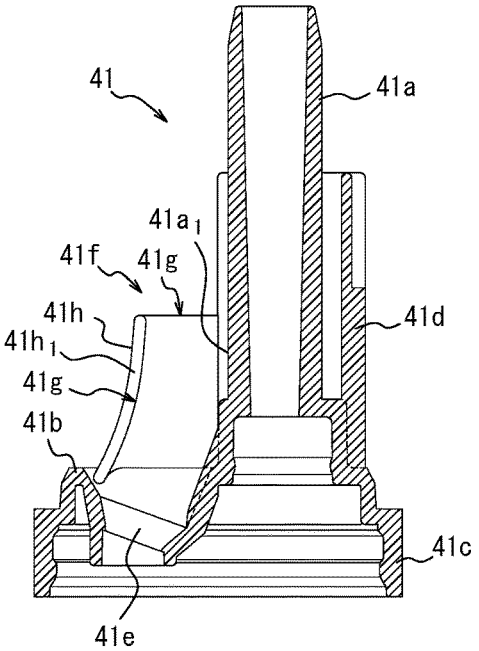
FIG. 3A is a side sectional view.
Figure 4C:
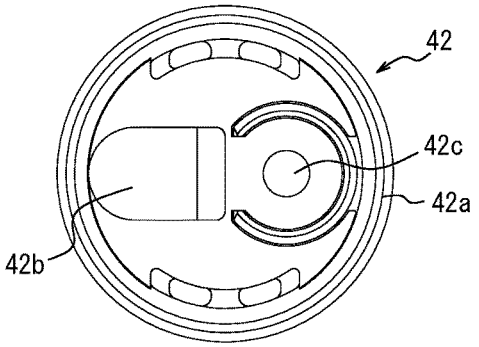
FIG. 4C is a plan view.
Figure 4A:
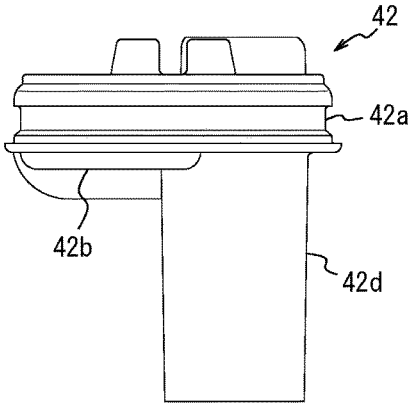
FIG. 4A is a side view.
Figure 4B:
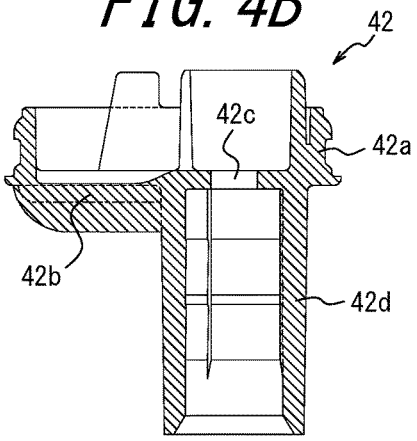
FIG. 4B is a side sectional view.
Figure 4D:
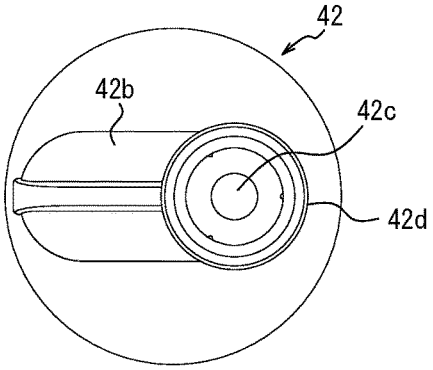
FIG. 4D is a bottom view, each illustrating a pipe holding member constituting an upright and inverted dual unit of a trigger-type liquid dispenser illustrated in FIG. 1.

As illustrated in FIG. 2, the upright and inverted dual unit 40 is attached between the drawing pipe 50 and the intake 33. The upright and inverted dual unit 40 includes a joint member 41, which is attached to the dispenser main body 30, a pipe holding member 42, which is attached to the joint member 41 to hold the drawing pipe 50 suspended in the container C, and a spherical-shaped valve body 43.

As illustrated in FIG. 2 and FIGS. 3A to 3C, the joint member 41 includes an inserted tubular portion 41*a*, which is inserted to the tubular portion 33*a* of the intake 33 of the dispenser main body 30 and which defines inside thereof a flow path for the content liquid, a ceiling wall portion 41*b*, which extends to the outer side in the radial direction from a lower end of the inserted tubular portion 41*a*, an attachment wall portion 41*c*, which suspends from an outer circumferential edge of the ceiling wall portion 41*b*, and an auxiliary tubular portion 41*d*, which stands from the ceiling wall portion 41*b* on the outer side of the inserted tubular portion 41*a* in the radial direction. The ceiling wall portion 41*b* is provided with a through hole 41*e*, which may be closed from above by the valve body 43.

The joint member 41 further includes a valve-body-holding wall portion 41*f*, which accommodates the valve body 43 above the through hole 41*e* in a manner such that the valve body 43 is displaceable upward and downward and is prevented from slipping off, and an opening portion 41*g*, which is formed in the valve-body-holding wall portion 41*f*. The valve-body-holding wall portion 41*f* is configured by a portion 41$a_1$ of an outer circumferential surface of the inserted tubular portion 41*a* and a pair of curved plate portions 41*h*, which stand from the ceiling wall portion 41*b* and oppose to each other at a distance therebetween.

In the present embodiment, the opening portion 41*g* is formed between front end edges 41$h_1$ of the pair of curved plate portions 41*h*, between upper end edges 41$h_2$ of the pair of curved plate portions 41*h*, and between each of rear end edges 41$h_3$ of the pair of curved plate portions 41*h* and the inserted tubular portion 41*a*. The upper end edges 41$h_2$ of the pair of curved plate portion 41*h* are formed as narrowed portions 41*j*, which are curved to narrow the distance between the pair of curved plate portions 41*h* as the curved plate portions 41*h* extend upward. The valve body 43 may be inserted through the opening portion 41*g* between the upper end edges 41$h_2$ of the pair of curved plate portions 41*h* by pressing the valve body 43 from above against the narrowed portions 41*j*. Thus, the valve body 43 may be accommodated in the valve-body-holding wall portion 41*f*. Herein, for smooth displacement of the valve body 43 due to its own weight, the valve body 43 is preferably made of metal, and the joint member 41 is preferably made of synthetic resin. This preferably allows insertion of the valve body 43 due to elastic deformation of the upper end edges 41$h_2$ of the pair of curved plate portion 41*h*.

As illustrated in FIG. 2, FIGS. 3A to 3C, and FIGS. 4A to 4D, the pipe holding member 42 includes an outer circumferential wall portion 42*a*, which is fitted in the attachment wall portion 41*c* of the joint member 41, a bottom wall portion 42*b*, which extends to the inner side in the radial direction from a lower and of the outer circumferential wall portion 42*a* and which defines a flow path between the bottom wall portion 42*b* and the ceiling wall portion 41*b* of the joint member 41, a hole portion 42*c*, which is formed in the bottom wall portion 42*b*, and a pipe holding tubular portion 42*d*, which is suspended from the bottom wall portion 42*b* on the outer side in the radial direction of the hole portion 42*d* to hold the drawing pipe 50.

In the inverted position of the container C, the upright and inverted dual unit 40 permits the content liquid contained in a container C to be supplied to the dispenser main body 30 by passing the content liquid through a flow path from the opening portion 41*g*, the through hole 41*e*, to a flow path defined between the ceiling wall portion 41*b* of the joint member 41 and the bottom wall portion 42*b* of the pipe holding member 42 sequentially. On the other hand, in the upright position of the container C, the upright and inverted dual unit 40 permits the content liquid to be supplied from the drawing pipe 50 to the dispenser main body 30 by the valve body 43 closing the through hole 41*e*.

Next, a description is given of a sequence of operation from actuation of the pump 31 to delivery of the liquid contained in the container C to the nozzle 70 in the upright position, as an example.

Once the operation lever 60 is operated manually and pulled to a stroke limit position represented by a two-dot chain line in FIG. 1 toward the pump 31, the first check valve 33*b* is closed, and the piston 35 is pushed into the partition chamber 34*b*. This increases liquid pressure in the pump 31 and causes the liquid within the pump 31 to be delivered from the hole 34*d* to the nozzle 70 via the second check valve 33*c*.

When the operation of the operation lever 60 is released, the operation lever 60 is returned to an initial position due to resilience of the plate spring 63. In conjunction with the return movement, the second check valve 33*c* is closed, the first check valve 33*b* is opened, and the liquid contained in the container C is drawn from the hole 34*d* into the pump 31 via the drawing pipe 50 and the first check valve 33*b*. Additionally, the aforementioned ambient air inlet 34*e* is provided in a position of the cylinder tube 34*a* that permits the ambient air inlet 34*e* to be exposed to the outside when the operation lever 60 is operated to the stroke limit. The ambient air inlet 34*e* permits the inside of the cylinder tube 34*a* to communicate with the outside and also communicates with the hole 32*f* provided in the fitting wall 32*e* via the gap formed between the fitting wall 32*e* and the cylinder tube 34*a*. As represented by a dash line arrow in FIG. 1, air drawn through the ambient air inlet 34*e* passes through the gap between the cylinder tube 34*a* of the pump 31 and the fitting wall 32*e* and subsequently, passes through the hole 32*f*. After passing through the hole 32*f*, air passes through a gap formed between the fitting wall 32*e* and the tubular portion 33*a* and then, passes through a gap formed between the auxiliary tubular portion 41*d* of the joint member 41 and the mouth of the container C, and thus, air is drawn into the container C. Accordingly, after the content liquid is dispensed, the space in the container C is replaced with air.

By thus fitting the trigger-type liquid dispenser 1 according to the present disclosure to the mouth of the container C and repeating the pulling and the releasing operation of the operation lever 60, the pump 31 is actuated to deliver the liquid contained in the container C to the nozzle 70 through the first check valve 33*b* and the second check valve 33*c*.

According to the trigger-type liquid dispenser 1 of the present embodiment with the above configuration, the joint member 41 includes the through hole 41*e*, which may be closed from above by the valve body 43, a valve-body-holding wall portion 41*f*, which accommodates the valve body 43 above the through hole 41*e* in a manner such that the valve body 43 is displaceable upward and downward and is prevented from slipping off, and an opening portion 41*g*, which is formed in the valve-body-holding wall portion 41*f*. Furthermore, in the inverted position of the container C, the upright and inverted dual unit 40 permits the content liquid contained in the container C to be supplied to the dispenser main body 30 by passing the content liquid through a flow path from the opening portion 41*g*, the through hole 41*e*, to a flow path defined between the joint member 41 and the pipe holding member 42 sequentially, and in the upright position of the container C, the upright and inverted dual unit 40 permits the content liquid to be supplied from the drawing pipe 50 to the dispenser main body 30 by the valve body 43 closing the through hole 41*e*. Moreover, the valve body 43 is inserted through the opening portion 41*g* to be accommodated in the valve-body-holding wall portion 41*f*. Accordingly, the upright and inverted dual unit 40 may be configured by the three members, namely, the joint member 42, the pipe holding member 42, and the valve body 43. Thus, the intermediate member, which is conventionally needed, may be omitted, and the number of components is reduced.

Besides, regarding assembly of the upright and inverted dual unit 40 according to the trigger-type liquid dispenser 1, the valve body 43 is inserted through the opening portion 41*g* to be accommodated in the valve-body-holding wall portion 41*f* in a manner such that the valve body 43 is prevented from slipping off. Accordingly, subsequent falling of the valve body 43 is prevented, and the assembly is facilitated.

The descriptions above are considered to be merely illustrative of one of embodiments of the present disclosure, and various changes may be made within the scope of the claims. For example, in the description of the above embodiment, the upper end edges 41$h_2$ of the pair of curved plate portion 41*h* are formed as narrowed portions 41*j*, and the valve body 43 is inserted through the opening portion 41*g* formed between the upper end edges 41$h_2$ of the pair of curved plate portions 41*h* to be accommodated in the valve-body-holding wall portion 41*f*. However, the present disclosure is not limited to the above configuration, and for example, the narrowed portions 41*j*, through which the valve body 43 may be inserted, may be formed in the front end edges 41$h_1$ of the pair of curved plate portions 41*h*, and the valve body 43 may be inserted through the opening portion 41*g* formed between the front end edges 41$h_1$ of the pair of curved plate portions 41*h* to be accommodated in the valve-body-holding wall portion 41*f*.

Next, a description is given of a trigger-type liquid dispenser 2 according to the second embodiment of the present disclosure with reference to FIG. 5, FIGS. 6A to 6D, and FIGS. 7A to 7C.

Figure 5:
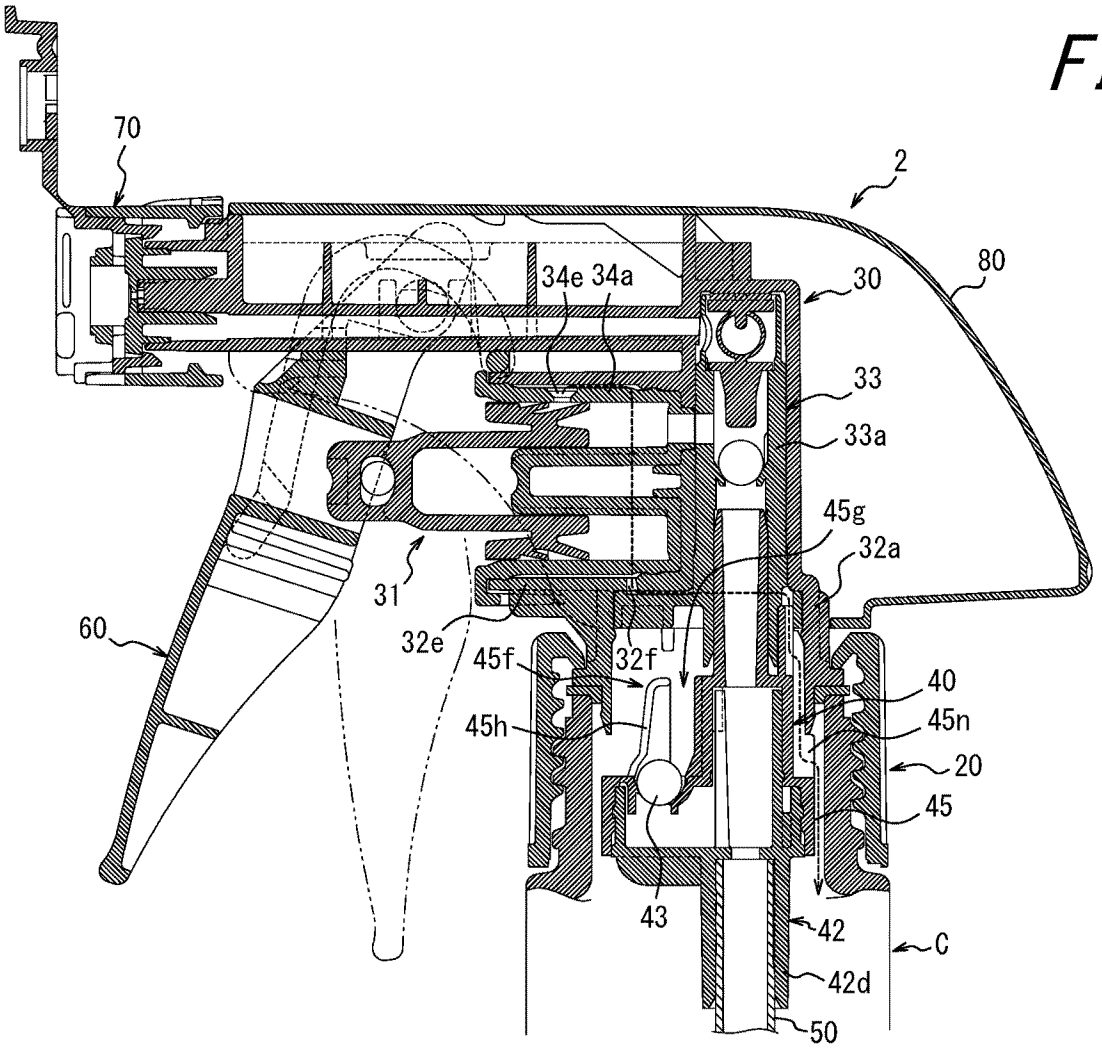
FIG. 5 is a side sectional view illustrating the state where a trigger-type liquid dispenser is attached to a mouth of a container according to the second embodiment of the present disclosure.

As illustrated in FIG. 5, the trigger-type liquid dispenser 2 according to the second embodiment of the present disclosure includes the fitting cap 20, which is attached to a mouth of the container C, the dispenser main body 30, which holds the fitting cap 20 in a manner such that the fitting cap 20 is rotatable and is prevented from slipping off, the upright and inverted dual unit 40, which permits supply of a content liquid contained in the container C to the dispenser main body 30 regardless of whether the container C is in an upright position or an inverted position, the drawing pipe 50, which is suspended in the container C, the operation lever (trigger) 60, which is supported swingably by the dispenser main body 30 and configured to actuate the pump 31 included in the dispenser main body 30, the nozzle 70, which is attached to a front portion of the dispenser main body 30 to dispense the content liquid to the outside, and the cover 80, which covers the upper side and the sides of the dispenser main body 30.

The trigger-type liquid dispenser 2 according to the second embodiment of the present disclosure illustrated in FIG. 5 differs from the trigger-type dispenser 1 according to the first embodiment of the present disclosure illustrated in FIG. 1 only in that the shape and the function of the joint member 45 of the upright and inverted dual unit 40 partly differ from those of the joint member 41. Accordingly, the description below focuses on differences from the trigger-type dispenser 1 according to the first embodiment of the present disclosure.

As illustrated in FIG. 5, the upright and inverted dual unit 40 is attached between the drawing pipe 50 and the intake 33. The upright and inverted dual unit 40 includes the joint member 45, which is attached to the dispenser main body 30, the pipe holding member 42, which is attached to the joint member 45 to hold the drawing pipe 50 suspended in the container C, and the spherical-shaped valve body 43.

As illustrated in FIG. 5 and FIGS. 6A to 6D, the joint member 45 includes an inserted tubular portion 45*a*, which is inserted to the tubular portion 33*a* of the intake 33 of the dispenser main body 30 and which defines inside thereof a flow path for the content liquid, a ceiling wall portion 45*b*, which extends to the outer side in the radial direction from a lower end of the inserted tubular portion 45*a*, an attachment wall portion 45*c*, which is suspended from an outer circumferential edge of the ceiling wall portion 45*b*, and an auxiliary tubular portion 45*d*, which stands from the ceiling wall portion 45*b* on the outer side in the radial direction of the inserted tubular portion 45*a*. The ceiling wall portion 45*b* is provided with a through hole 45*e*, which may be closed from above by the valve body 43.

The joint member 45 further includes a valve-body-holding wall portion 45*f*, which accommodates the valve body 43 above the through hole 45*e* in a manner such that the valve body 43 is displaceable upward and downward and is prevented from slipping off, and an opening portion 45*g*, which is formed in the valve-body-holding wall portion 45*f*. The valve-body-holding wall portion 45*f* is configured by a protruding portion 45$a_1$, which protrudes from an outer circumferential surface of the inserted tubular portion 45*a* further toward the valve body 43, and a pair of curved plate portions 45*h*, which stand from the ceiling wall portion 45*b* vertically and oppose to each other at a distance therebetween.

In the present embodiment, the opening portion 45*g* is formed between front end edges 45$h_1$ of the pair of curved plate portions 45*h*, between upper end edges 45$h_2$ of the pair of curved plate portions 45*h*, and between each of rear end edges 45$h_3$ of the pair of curved plate portions 45*h* and the protruding portion 45$a_1$ protruding from the inserted tubular portion 45*a*. As illustrated in FIG. 6B, the upper end edges 45$h_2$ of the pair of curved plate portion 45*h* are formed as narrowed portions 45*j*, which are curved to narrow the distance between the pair of curved plate portions 45*h* as the curved plate portions 45*h* extend upward. Furthermore, as illustrated in FIG. 6A, the upper end edges 45$h_2$ each have a dome shape, and the narrowed portions 45*j* are curved inward. The valve body 43 may be inserted through the opening portion 45*g* between the upper end edges 45$h_2$ of the pair of curved plate portions 45*h* by pressing the valve body 43 from above against the narrowed portions 45*j*. Thus, the valve body 43 may be accommodated in the valve-body-holding wall portion 45*f*. Herein, for smooth displacement of the valve body 43 due to its own weight, the valve body 43 is preferably made of metal, and the joint member 45 is preferably made of synthetic resin. This preferably allows insertion of the valve body 43 due to elastic deformation of the upper end edges 45$h_2$ of the pair of curved plate portion 45*h*.

Figure 6C:
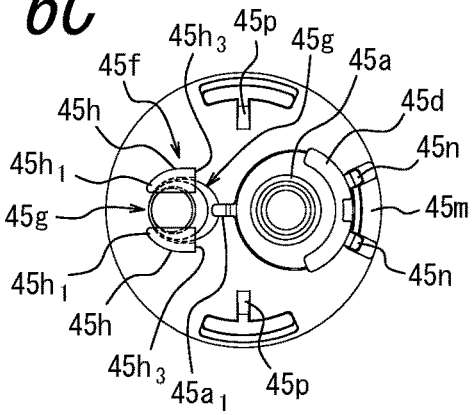
FIG. 6C is a plan view.
Figure 6B:
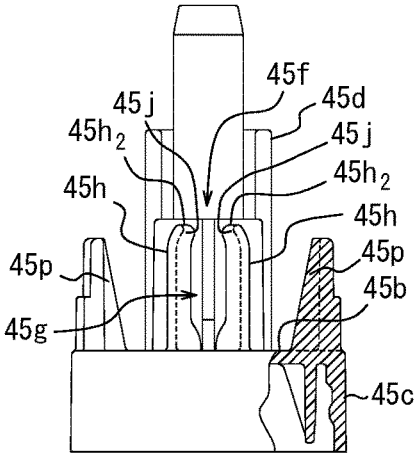
FIG. 6B is a front view.
Figure 6A:
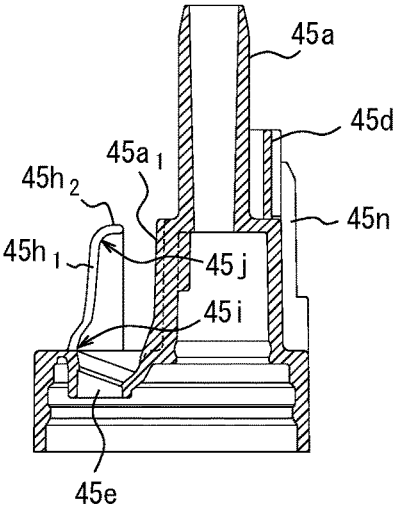
FIG. 6A is a side sectional view.
Figure 6D:
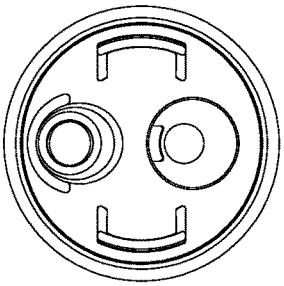
FIG. 6D is a bottom view, each illustrating a joint member constituting an upright and inverted dual unit of a trigger-type liquid dispenser illustrated in FIG. 5.

In FIGS. 6B and 6C, a support member 45*p* is illustrated. The support member 45*p* is used to position and support the joint member 45 with respect to the intake 33 and the body 32.

Additionally, although in the present embodiment the upper end edges 45$h_2$ each have a dome shape, the present disclosure is not limited to this embodiment, and the upper end edges 45$h_2$ only need to include the narrowed portions 45*j*, which are curved to be narrowed inward.

Figure 7A:
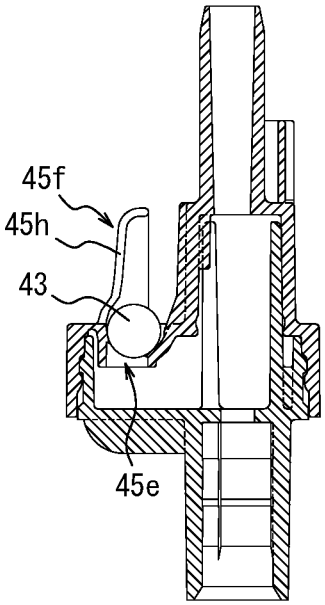
FIGS. 7A, 7B, and 7C are sectional views respectively illustrating an upright position, a sideways position, and an obliquely inverted position of a joint member and a pipe holding member that constitute a trigger-type liquid dispenser according to the second embodiment of the present disclosure.
Figure 7B:
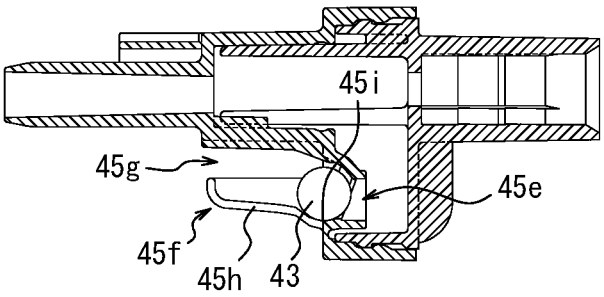

In the upright position of the container C, as illustrated in FIG. 7A, the upright and inverted dual unit 40 permits the content liquid to be supplied to the dispenser main body 30 from the drawing pipe 50 to the dispenser main body 30 by the valve body 43 closing the through hole 45*e*.

Then, when the container C is brought to a sideways position, the valve body 43 is displaced in a direction away from the through hole 45*e*, thereby opening the through hole 45*e*. At this time, in cases where the through hole 45*e* is not completely filled with the content liquid, air from the ambient air inlet 34*e*, together with the content liquid, is drawn into the cylinder tube 34*a* through the through hole 45*e*. Consequently, the air-entrained content liquid is dispensed.

In the present embodiment, the valve body 43 is received in the concave portion 45*i* and positioned in the vicinity of the through hole 45*e* with a predetermined gap maintained with respect to the through hole 45*e*. Accordingly, when the operation lever 60 is returned to an initial position due to resilience of the plate spring 63 and when the through hole 45*e* is placed under negative pressure, the valve body 43 is quickly displaced to closely contact the through hole 45*e* for sealing. This prevents inflow of air from the ambient air inlet 34*e* through the through hole 45*e*. Additionally, in the sideways position, the content liquid is supplied mainly from the drawing pipe 50.

Figure 7C:
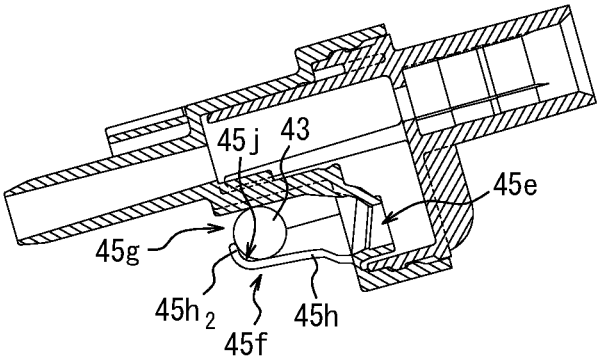

Then, as illustrated in FIG. 7C, when the container C is tilted so that the mouth of the container C faces obliquely downward, the content liquid is supplied to the surroundings of the valve-body-holding wall portion 45*f* in a reliable manner. The valve body 43 is displaced toward the upper end edges 45$h_2$, and the content liquid is supplied to the dispenser main body 30 thorough the through hole 45*e*. The upper end edges 45$h_2$, which include the dome-shaped narrowed portions 45*j*, of the curved plate portions 45*h* hinder movement of the valve body 43, thus requiring the valve body 43 to stay within the valve-body-holding wall portion 45*f*. Accordingly, operation of the trigger-type liquid dispenser 2 in the above state where the mouth of the container C faces obliquely downward is similar to operation in the inverted position.

Additionally, the joint member 45 in the present embodiment includes, in a position thereof opposed to the pump 31 about the center axis of the pipe holding tubular portion 42*d* included in the pipe holding member 42, two ribs 45*n*, which are disposed at a predetermined interval in the circumferential direction and which extend longitudinally. When the operation lever 60 is returned to the original position due to resilience of the plate spring 63 and when the inside of the cylinder tube 34*a* is placed under negative pressure, the content liquid contained in the container C is filled into the cylinder tube 34*a*, thereby placing the inside of the container C under negative pressure. At this time, as represented by a dash line arrow in FIG. 5, air drawn through the ambient air inlet 34*e* passes through the gap between the cylinder tube 34*a* of the pump 31 and the fitting wall 32*e* and subsequently, passes through the hole 32*f*. After passing through the hole 32*f*, air passes through the gap formed between the fitting wall 32*e* and the tubular portion 33*a* and reaches the ribs 45*n*. Air proceeds downward along an interval 45*m* formed between the ribs 45*n* and flows into the container C. In this way, air, introduced from the ambient air inlet 34*e*, reaches the container C by passing through a bypass passage, which is more restricted compared with the first embodiment. Accordingly, inflow of the air is restricted by greater inflow resistance, and it is ensured that air, introduced from the ambient air inlet 34*e*, may be prevented from passing through the through hole 45*e* directly to reach the pump 31.

According to the trigger-type liquid dispenser 2 of the present embodiment, the valve-body-holding wall portion 45*f* includes the concave portion 45*i*. In the sideways position, the concave portion 45*i* permits the valve body 43 to be positioned on an abutment surface of the valve-body-holding wall portion 45*f* with respect to the valve body 43, with a predetermined gap provided with respect to the through hole 45*e*. Accordingly, when the through hole 45*e* is placed under negative pressure in the sideways position, the valve body 43 quickly seals the through hole 45*e*, and this prevents inflow of air from the ambient air inlet 34*e* through the through hole 45*e*.

Moreover, according to the trigger-type liquid dispenser 2, the pair of curved plate portions 45*h* include, in the upper end edges 45$h_2$ thereof, the dome-shaped narrowed portions 45*j*, which are curved inward. Accordingly, it is ensured that the valve body 43 may be prevented from falling off the valve-body-holding wall portion 45*f*.

Moreover, according to the trigger-type liquid dispenser 2, the joint member 45 includes, in a position thereof opposed to the pump 31 about the center axis of the pipe holding tubular portion 42*d* included in the pipe holding member 42, the plurality of ribs 45*n*, which is disposed at a predetermined interval in the circumferential direction and which extends in the direction of the center axis. Accordingly, air, introduced from the ambient air inlet 34*e*, passes through the bypass passage to reach the container C, and inflow of air is restrained by a predetermined inflow resistance. It is therefore ensured that air, introduced from the ambient air inlet 34*e*, may be prevented from passing through the through hole 45*e* directly to reach the pump 31.

REFERENCE SIGNS LIST

1 Trigger-type liquid dispenser
20 Fitting cap
21 Side wall
21*a* Screw portion
22 Upper orifice
23 Ceiling wall
30 Dispenser main body
31 Pump
32 Body
32*a* Coupling tubular portion
32*b* Flange
32*c* Longitudinal tube
32*d* Horizontal tube
32*e* Fitting wall
32*f* Hole
33 Intake
33*a* Tubular portion
33*b* First check valve
33*c* Second check valve
33*d* Hole
34 Cylinder member
34*a* Cylinder tube
34*b* Partition tube
34*c* Back wall
34*d* Hole
34*e* Ambient air inlet
35 Piston
35*a* Slide portion
35*b* Circumferential wall portion
40 Upright and inverted dual mechanism
41, 45 Joint member
41*a*, 45*a* Inserted tubular portion
41$a_1$ Portion of outer circumferential surface of inserted tubular portion
41*b*, 45*b* Ceiling wall portion
41*c*, 45*c* Attached wall portion
41*d*, 45*d* Auxiliary tubular portion
41*e*, 45*e* Through hole
41*f*, 45*f* Valve-body-holding wall portion
41*g*, 45*g* Opening portion
41*h*, 45*h* Pair of curved plate portions
41$h_1$, 45$h_1$ Front end edges of pair of curved plate portions
41$h_2$, 45$h_2$ Upper end edges of pair of curved plate portions
41$h_3$, 45$h_3$ Rear end edges of pair of curved plate portions
41*j*, 45*j* Narrowed portion
42 Pipe holding member
42*a* Outer circumferential portion
42*b* Bottom wall portion
42*c* Hole portion
42*d* Pipe holding tubular portion
43 Valve body
45$a_1$ Protruding portion
45*i* Concave portion
45*m* Interval
45*n* Rib
45*p* Support member
50 Drawing pipe
60 Operating lever

61 Pivot shaft
62 Pin member
63 Plate spring
70 Nozzle
80 Cover
C Container
R Cylinder chamber

The invention claimed is:

1. A trigger-type liquid dispenser comprising a dispenser main body that is attached to a mouth of a container and includes:

a pump, an upright and inverted dual unit that permits supply of a content liquid contained in the container to the dispenser main body in an upright position or an inverted position, and an operation lever that is supported swingably by the dispenser main body and is configured to actuate the pump, wherein:

the dispenser main body is configured to draw, pressurize, and force-feed the content liquid supplied from the upright and inverted dual unit and dispense the content liquid through a nozzle attached to the dispenser main body due to actuation of the pump in response to pulling of the operation lever, the upright and inverted dual unit includes:

a joint member that is attached to the dispenser main body, a pipe holding member that is attached to the joint member and that holds a drawing pipe suspended in the container, and a valve body, the joint member includes:

a through hole that is closable from above by the valve body, a valve-body-holding wall portion that accommodates the valve body above the through hole in a manner such that the valve body is displaceable upward and downward and is prevented from slipping off, and an opening portion that is formed in the valve-body-holding wall portion, in the inverted position, the upright and inverted dual unit permits the content liquid contained in the container to be supplied to the dispenser main body by passing through a flow path from the opening portion, the through hole, to a flow path defined between the joint member and the pipe holding member sequentially, in the upright position, the upright and inverted dual unit permits the content liquid to be supplied from the drawing pipe to the dispenser main body by the valve body closing the through hole, and the valve body is inserted through the opening portion to be accommodated in the valve-body-holding wall portion.

2. The trigger-type liquid dispenser according to claim 1, wherein the valve-body-holding wall portion includes a pair of curved plate portions facing to each other with a distance provided therebetween.

3. The trigger-type liquid dispenser according to claim 2, wherein the joint member further includes an inserted tubular portion that is inserted to the dispenser main body and that defines inside thereof a flow path for the content liquid, and the valve-body-holding wall portion is configured by a portion of an outer circumferential surface of the inserted tubular portion and the pair of curved plate portions.

4. The trigger-type liquid dispenser according to claim 2, wherein the valve-body-holding wall portion further includes a concave portion that, in a sideways position, permits the valve body to be positioned on an abutment surface of the valve-body-holding wall portion with respect to the valve body, with a predetermined gap provided with respect to the through hole.

5. The trigger-type liquid dispenser according to claim 2, wherein each of the pair of curved plate portions includes a narrowed portion on an upper end edge of the curved plate portion, the narrowed portion being curved inward.

6. The trigger-type liquid dispenser according to claim 5, wherein the narrowed portion has a dome shape.

7. The trigger-type liquid dispenser according to claim 1, wherein the joint member further includes, in a position thereof opposed to the pump about a center axis of a pipe holding tubular portion included in the pipe holding member, a plurality of ribs that is disposed in a circumferential direction at a predetermined interval and that extends in a direction of the center axis.

* * * * *